US011262105B2

(12) United States Patent
Maruyama

(10) Patent No.: US 11,262,105 B2
(45) Date of Patent: Mar. 1, 2022

(54) CRYOCOOLER AND CRYOCOOLER PIPE SYSTEM

(71) Applicant: SUMITOMO HEAVY INDUSTRIES, LTD., Tokyo (JP)

(72) Inventor: Toru Maruyama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/005,220

(22) Filed: Aug. 27, 2020

(65) Prior Publication Data

US 2020/0393168 A1 Dec. 17, 2020

Related U.S. Application Data

(63) Continuation of application No. PCT/JP2019/008209, filed on Mar. 1, 2019.

(30) Foreign Application Priority Data

Mar. 7, 2018 (JP) ..... JP2018-040922

(51) Int. Cl.
*F25B 49/02* (2006.01)
*F25B 9/14* (2006.01)

(52) U.S. Cl.
CPC ..... *F25B 9/14* (2013.01); *F25B 49/02* (2013.01)

(58) Field of Classification Search
CPC .. F25B 49/02; F25B 9/14; F25B 9/002; F25B 9/00; H01F 6/04; F04B 6/04; B01D 3/42
See application file for complete search history.

(56) References Cited

U.S. PATENT DOCUMENTS 6,286,327 B1 * 9/2001 Karl ..... F25B 41/20 62/196.4
8,874,274 B2 10/2014 McDonald et al.
9,938,968 B2 4/2018 Ando
10,288,052 B2 5/2019 Dresens et al.
(Continued)

FOREIGN PATENT DOCUMENTS

EP 3191712 B1 * 3/2019 ..... F04B 37/18
JP H05113259 A 5/1993
(Continued)

OTHER PUBLICATIONS

Hohne, Compressor Device, 2015, Full Document (Year: 2015).*

*Primary Examiner* — Elizabeth J Martin
*Assistant Examiner* — Nael N Babaa
(74) *Attorney, Agent, or Firm* — HEA Law PLLC

(57) ABSTRACT

There is provided a cryocooler including a first compressor, a second compressor, a cold head that has a high pressure port and a low pressure port, a high pressure line that is configured such that a refrigerant gas is able to flow from the first compressor and the second compressor to the high pressure port of the cold head via a merging portion, the high pressure line including a first high pressure sub-line and a second high pressure sub-line, and a low pressure line that is configured such that the refrigerant gas is able to flow from the low pressure port of the cold head to the first compressor and the second compressor via a diverting portion, the low pressure line including a first low pressure sub-line and a second low pressure sub-line.

11 Claims, 7 Drawing Sheets

(56) References Cited

U.S. PATENT DOCUMENTS

| | | | | |
|---|---|---|---|---|
| 2015/0255977 | A1* | 9/2015 | Jonas | G01R 33/3815 361/19 |
| 2017/0175729 | A1 | 6/2017 | Hoehne | |
| 2017/0176055 | A1 | 6/2017 | Seitz et al. | |
| 2019/0003743 | A1 | 1/2019 | Pfleiderer et al. | |

FOREIGN PATENT DOCUMENTS

| | | | |
|---|---|---|---|
| JP | 2000121192 | A | 4/2000 |
| JP | 2000292024 | A | 10/2000 |
| JP | 2003113779 | A | 4/2003 |
| JP | 2008014599 | A | 1/2008 |
| JP | 2011510600 | A | 3/2011 |
| JP | 2012067633 | A | 4/2012 |
| JP | 2017528644 | A | 9/2017 |
| KR | 101741708 | B1 | 5/2017 |
| WO | 2017106590 | A1 | 6/2017 |
| WO | 2017114866 | A1 | 7/2017 |

* cited by examiner

CRYOCOOLER AND CRYOCOOLER PIPE SYSTEM

RELATED APPLICATIONS

The contents of Japanese Patent Application No. 2018-040922 and of International Patent Application No. PCT/JP2019/008209, on the basis of each of which priority benefits are claimed in an accompanying application data sheet, are in their entirety incorporated herein by reference.

BACKGROUND

Technical Field

Certain embodiments of the present invention relate to a cryocooler and a cryocooler pipe system.

Description of Related Art

Typically, a cryocooler can be configured as a combination of one cryocooler and one compressor that supplies a refrigerant gas to the cryocooler. The cryocooler is also called a cold head or an expander. When the running compressor stops abnormally for some reason, it is difficult for the cryocooler to continue to provide a desired cooling capacity thereafter. Causes of abnormal stop of the compressor include, for example, a failure of a power supply system to the compressor such as power stoppage, a malfunction of cooling facilities of the compressor, such as abnormal quality deterioration of a refrigerant including cooling water, and various external factors that cannot be controlled or are difficult to be responded with the cryocooler itself, such as severe fluctuations which exceed provision environments of the compressor, including a temperature, humidity, and an air pressure.

Thus, a configuration, in which two compressors are provided for one cryocooler, one of which is set as a main compressor, and the other is set as a standby compressor, is proposed. When the main compressor has stopped due to some abnormality, the standby compressor is started. A refrigerant gas pipe extending from the one cryocooler branches in the middle and is connected to each of the two compressors. A three-port switching valve that operates electrically is disposed at a branch point of the refrigerant gas pipe. The three-port switching valve is switched by an electric signal such that normally the cryocooler is connected to the main compressor and the standby compressor is separated from the cryocooler, while the main compressor is separated from the cryocooler and the cryocooler is connected to the standby compressor when the main compressor stops abnormally.

SUMMARY

In the configuration descried above, the three-port switching valve operates depending on a supplied electric signal. For this reason, considering that there is a possibility that some malfunction or misoperation occurs in a supply system of an electric signal to the three-port switching valve, reliable performance of a switching operation of the three-port switching valve at a necessary timing is not guaranteed. Since there is no connection of the refrigerant gas pipe to the cryocooler from the standby compressor when a necessary switching operation is not performed, the refrigerant gas is not supplied from the standby compressor to the cryocooler even when the standby compressor is operating. Accordingly, it is evident that it is difficult for the cryocooler to provide a cooling capacity.

According to an aspect of the present invention, there is provided a cryocooler including a first compressor, a second compressor, a cold head that has a high pressure port and a low pressure port, a high pressure line that is configured such that a refrigerant gas is able to flow from the first compressor and the second compressor to the high pressure port of the cold head via a merging portion, the high pressure line including a first high pressure sub-line which connects the first compressor to the merging portion and has a first check valve and a second high pressure sub-line which connects the second compressor to the merging portion and has a second check valve, and a low pressure line that is configured such that the refrigerant gas is able to flow from the low pressure port of the cold head to the first compressor and the second compressor via a diverting portion, the low pressure line including a first low pressure sub-line which connects the diverting portion to the first compressor and has a third check valve and a second low pressure sub-line which connects the diverting portion to the second compressor and has a fourth check valve.

According to another aspect of the present invention, there is provided a cryocooler pipe system including a high pressure line that is configured such that a refrigerant gas is able to flow from a first compressor and a second compressor to a high pressure port of a cold head via a merging portion, the high pressure line including a first high pressure sub-line which connects the first compressor to the merging portion and has a first check valve and a second high pressure sub-line which connects the second compressor to the merging portion and has a second check valve, and a low pressure line that is configured such that the refrigerant gas is able to flow from a low pressure port of the cold head to the first compressor and the second compressor via a diverting portion, the low pressure line including a first low pressure sub-line which connects the diverting portion to the first compressor and has a third check valve, and a second low pressure sub-line which connects the diverting portion to the second compressor and has a fourth check valve.

Any combination of the components, or a configuration where the components or expressions of the present invention are mutually substituted between methods, devices, systems is also effective as an aspect of the present invention.

DETAILED DESCRIPTION

It is desirable to provide a technique of making operational continuity of a cryocooler more reliable.

Hereinafter, embodiments for carrying out the present invention will be described in detail with reference to the drawings. In the description and drawings, the same or equivalent components, members, and processes will be assigned with the same reference symbols, and redundant description thereof will be omitted as appropriate. The scales and shapes of the illustrated parts are set for convenience in order to make the description easy to understand, and are not to be understood as limiting unless stated otherwise. The embodiments are merely examples and do not limit the scope of the present invention. All characteristics and combinations to be described in the embodiments are not necessarily essential to the invention.

Figure 1:
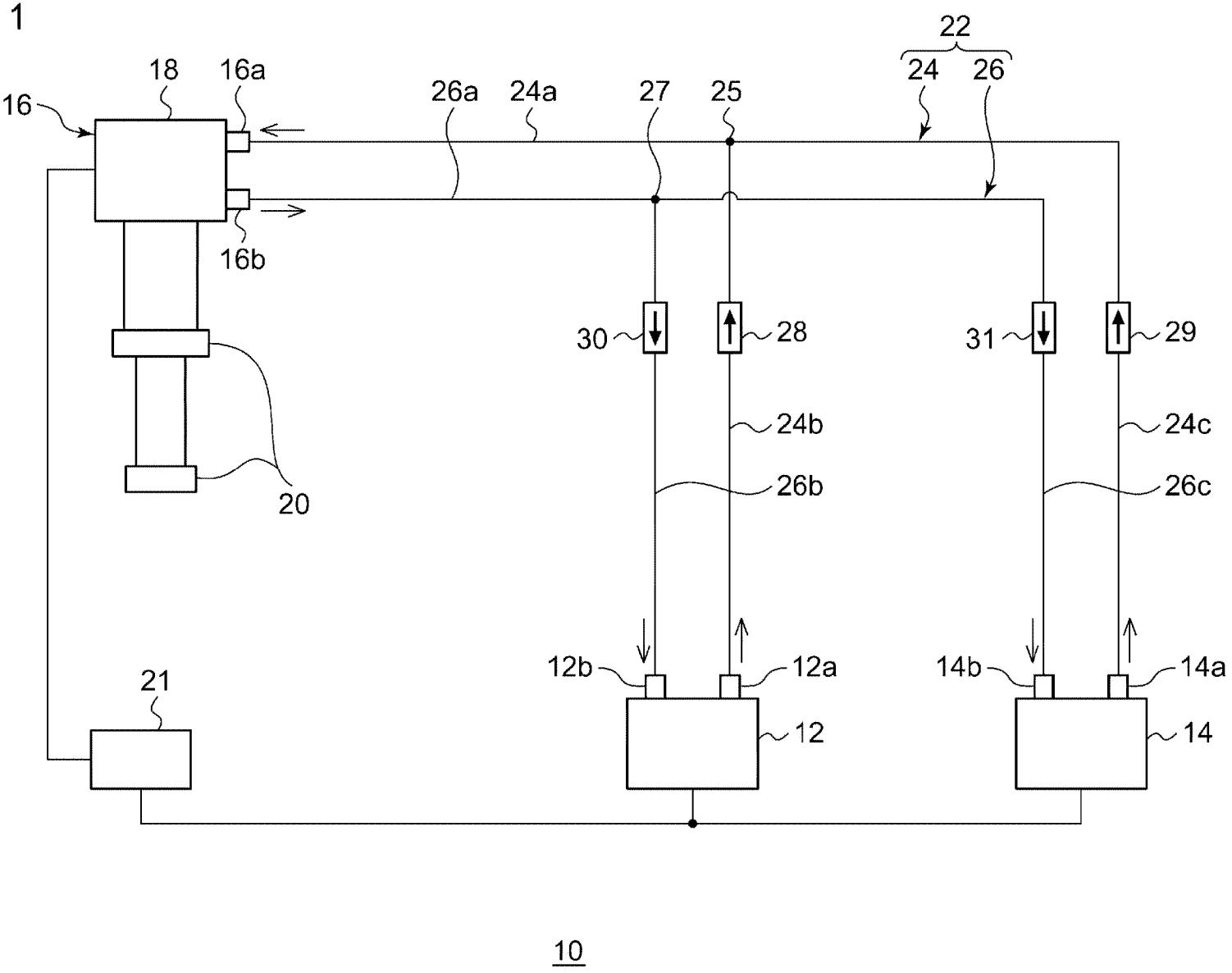
FIG. 1 is a diagram schematically showing a cryocooler according to one embodiment.

FIG. 1 is a diagram schematically showing a cryocooler 10 according to one embodiment.

The cryocooler 10 includes a first compressor 12, a second compressor 14, and a cold head 16. The first compressor 12 is configured to collect a refrigerant gas of the cryocooler 10 from the cold head 16, to pressurize the collected refrigerant gas, and to supply the refrigerant gas to the cold head 16 again. Similarly, the second compressor 14 is configured to collect a refrigerant gas of the cryocooler 10 from the cold head 16, to pressurize the collected refrigerant gas, and to supply the refrigerant gas to the cold head 16 again. Thus, the two compressors (12 and 14) are provided in parallel with one cold head 16.

As will be described later, the first compressor 12 is provided in the cryocooler 10 as a main compressor normally used in the cryocooler 10. The second compressor 14 is provided in the cryocooler 10 as a standby compressor used as a substitute for the first compressor 12 when the first compressor 12 has stopped due to some factor. It is also possible to operate the first compressor 12 and the second compressor 14 simultaneously.

The cold head 16 is also called an expander or a cryocooler, and has a room temperature section 18 and at least one low-temperature section 20. As illustrated, in a case where the cold head 16 is a two-stage type, the cold head 16 has the low-temperature section 20 in each of a first stage and a second stage. The low-temperature section 20 is also called a cooling stage.

A refrigeration cycle of the cryocooler 10 is configured by performing circulation of a refrigerant gas between the first compressor 12 (or the second compressor 14) and the cold head 16 with appropriate combination of pressure fluctuations and volume fluctuations of the refrigerant gas in the cold head 16, and thereby the low-temperature section 20 can be cooled to a desired cryogenic temperature. Accordingly, for example, a superconductive electromagnet or any other object to be cooled, which is thermally coupled to the low-temperature section 20, can be cooled to a target cooling temperature. Although the refrigerant gas is typically a helium gas, any other appropriate gas may be used. In order to facilitate understanding, a direction in which the refrigerant gas flows is indicated with an arrow in FIG. 1.

Although the cryocooler 10 is, for example, a single-stage or two-stage Gifford-McMahon (GM) cryocooler, the cryocooler may be a pulse tube cryocooler, a Sterling cryocooler, or other types of cryocoolers. The cold head 16 has a different configuration depending on the type of the cryocooler 10. The same configuration can be used in the first compressor 12 and the second compressor 14 regardless of the type of the cryocooler 10. For example, the first compressor 12 is a water cooling type compressor, and the second compressor 14 may be an air cooling type compressor.

In general, both of a pressure of a refrigerant gas supplied from the first compressor 12 and the second compressor 14 to the cold head 16 and a pressure of a refrigerant gas collected from the cold head 16 to the first compressor 12 and the second compressor 14 are significantly higher than the atmospheric pressure, and can be called a first high pressure and a second high pressure, respectively. For convenience of description, the first high pressure and the second high pressure are also simply called a high pressure and a low pressure, respectively. Typically, the high pressure is, for example, in a range of approximately 2 to 3 MPa, and the low pressure is in a range of approximately 0.5 to 1.5 MPa.

The first compressor 12 has a first discharge port 12*a* and a first suction port 12*b*. The first discharge port 12*a* is a refrigerant gas outlet provided in the first compressor 12 in order to deliver a refrigerant gas pressurized to a high pressure by the first compressor 12 from the first compressor 12, and the first suction port 12*b* is a refrigerant gas inlet provided in the first compressor 12 in order to receive a low-pressure refrigerant gas by the first compressor 12. Similarly, the second compressor 14 has a second discharge port 14*a* and a second suction port 14*b*.

The first compressor 12 is configured to be switched between performing and stopping (that is, turning on and turning off) of refrigerant gas compression operation, for example, through manual operation or through electrical control. Similarly, the second compressor 14 is configured to be switched between performing and stopping (that is, turning on and turning off) of refrigerant gas compression operation, for example, through manual operation or through electrical control.

The cold head 16 has a high pressure port 16*a* and a low pressure port 16*b*. The high pressure port 16*a* is a refrigerant gas inlet provided in the room temperature section 18 of the cold head 16 in order to receive a high-pressure working gas into the low-temperature section 20 of the cold head 16. The low pressure port 16*b* is a refrigerant gas outlet provided in the room temperature section 18 of the cold head 16 in order to exhaust a low-pressure refrigerant gas, which is obtained by depressurizing through the expansion of the refrigerant gas inside the low-temperature section 20 of the cold head 16, from the cold head 16.

In addition, the cryocooler 10 also includes a pipe system 22 that connects the first compressor 12 and the second compressor 14 to the cold head 16 to circulate a refrigerant gas therebetween. The pipe system 22 includes a high pressure line 24 and a low pressure line 26. The high pressure line 24 is configured such that the refrigerant gas can flow from the first compressor 12 and the second compressor 14 to the high pressure port 16*a* of the cold head 16 via a merging portion 25. The low pressure line 26 is configured such that the refrigerant gas can flow from the low pressure port 16*b* of the cold head 16 to the first compressor 12 and the second compressor 14 via a diverting portion 27.

The high pressure line 24 has a high pressure main line 24*a*, a first high pressure sub-line 24*b*, and a second high pressure sub-line 24*c*. The high pressure main line 24*a* connects the high pressure port 16*a* of the cold head 16 to the merging portion 25. The first high pressure sub-line 24*b* connects the merging portion 25 to the first discharge port 12*a* of the first compressor 12. The second high pressure sub-line 24*c* connects the merging portion 25 to the second discharge port 14*a* of the second compressor 14.

Since the high pressure line 24 is a flow path of a refrigerant gas from the first compressor 12 and the second compressor 14 to the cold head 16, a flow direction from the first compressor 12 and the second compressor 14 toward the cold head 16 can be called a forward direction of the high pressure line 24, and an opposite direction thereto can be called a reverse direction of the high pressure line 24. The forward direction corresponds to a direction of the illustrated arrow.

The first high pressure sub-line 24*b* has a first check valve 28, and the second high pressure sub-line 24*c* has a second check valve 29. The first check valve 28 is disposed in the first high pressure sub-line 24*b* to allow a refrigerant gas flow in the forward direction and to block a refrigerant gas flow in the reverse direction. Similarly, the second check valve 29 is disposed in the second high pressure sub-line 24*c* to allow a refrigerant gas flow in the forward direction and to block a refrigerant gas flow in the reverse direction.

In addition, the low pressure line 26 has a low pressure main line 26*a*, a first low pressure sub-line 26*b*, and a second low pressure sub-line 26*c*. The low pressure main line 26*a* connects the low pressure port 16*b* of the cold head 16 to the diverting portion 27. The first low pressure sub-line 26*b* connects the diverting portion 27 to the first suction port 12*b* of the first compressor 12. The second low pressure sub-line 26*c* connects the diverting portion 27 to the second suction port 14*b* of the second compressor 14.

Since the low pressure line 26 is a flow path of a refrigerant gas from the cold head 16 to the first compressor 12 and the second compressor 14, a flow direction from the cold head 16 toward the first compressor 12 and the second compressor 14 can be called a forward direction of the low pressure line 26, and an opposite direction thereto can be called a reverse direction of the low pressure line 26.

The first low pressure sub-line 26*b* has a third check valve 30, and the second low pressure sub-line 26*c* has a fourth check valve 31. The third check valve 30 is disposed in the first low pressure sub-line 26*b* to allow a refrigerant gas flow in the forward direction and to block a refrigerant gas flow in the reverse direction. Similarly, the fourth check valve 31 is disposed in the second low pressure sub-line 26*c* to allow a refrigerant gas flow in the forward direction and to block a refrigerant gas flow in the reverse direction.

All of the first check valve 28, the second check valve 29, the third check valve 30, and the fourth check valve 31 are configured to be opened in a case where a pressure of a refrigerant gas on an upstream side in the forward direction (that is, an inlet side to the check valve) exceeds a pressure of a refrigerant gas on a downstream side in the forward direction (that is, an outlet side of the check valve), and conversely to be closed in a case where the pressure of the refrigerant gas on the upstream side in the forward direction does not exceed the pressure of the refrigerant gas on the downstream side in the forward direction. In other words, each of the check valves (28 to 31) spontaneously opens when there is a refrigerant gas flow in the forward direction in the check valve due to a pressure loss caused in the flow in the forward direction by the check valve. On the other hand, each of the check valves (28 to 31) closes when a pressure difference (that is, an outlet pressure is higher than an inlet pressure) that can result in a refrigerant gas backflow between the outlet and the inlet of the check valve occurs. In this manner, the check valves that are opened and closed by the action of a differential pressure between the upstream side and the downstream side are generally available, and such a general-purpose check valve can be adopted in each of the check valves (28 to 31) as appropriate.

In addition, for example, although the high pressure line 24 and the low pressure line 26 are configured by flexible pipes, the pressure lines may be configured by rigid pipes.

It is possible for a power supply system of the cryocooler 10 to adopt various known configurations. For example, the first compressor 12, the second compressor 14, and the cold head 16 may be connected to a common power supply 21. The common power supply 21 may be configured to automatically switch between a main power supply such as a commercial power supply and a standby power supply such as a generator and/or a battery as necessary.

Figure 2:
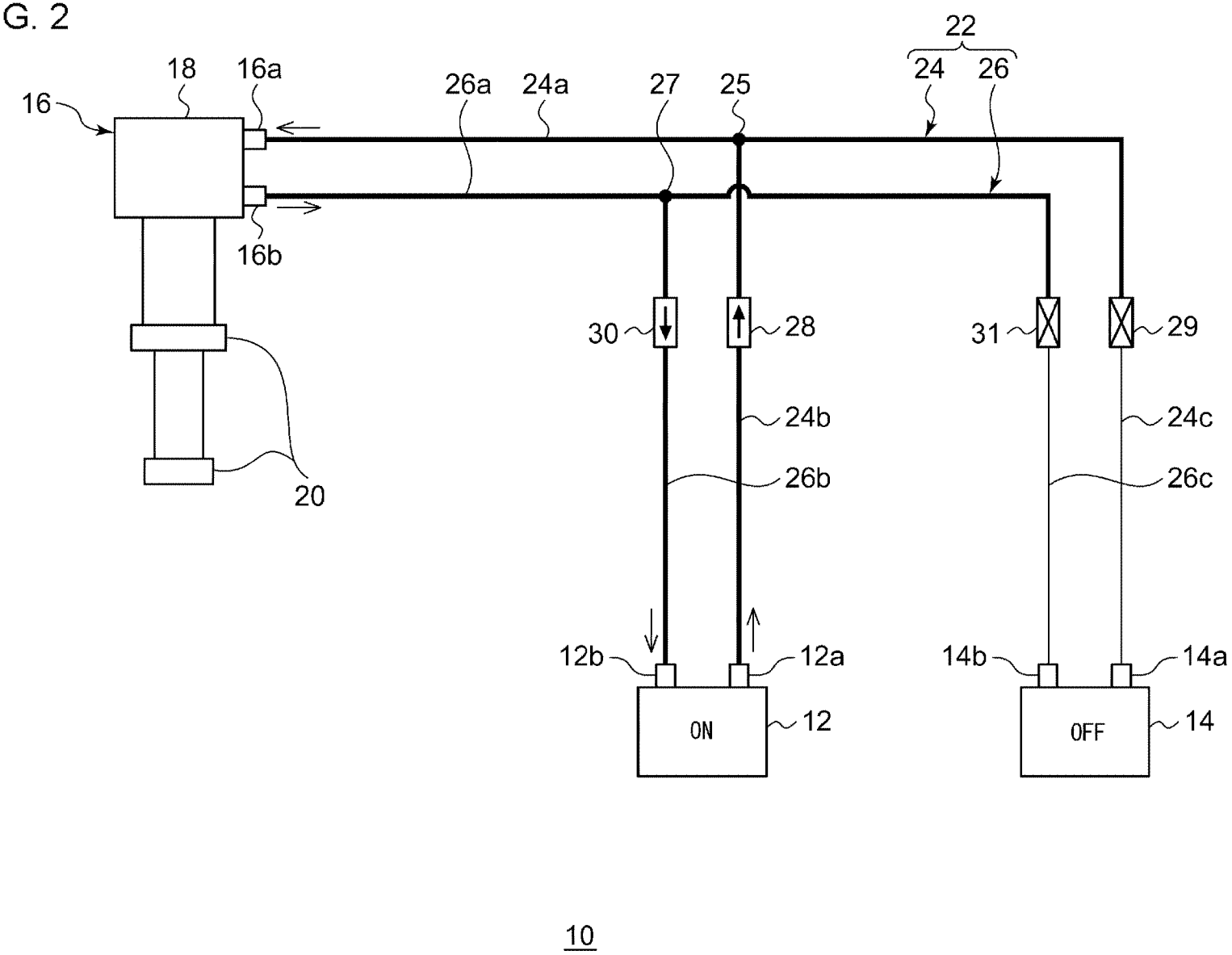
FIG. 2 is a diagram schematically showing a flow of a refrigerant gas in the cryocooler according to the one embodiment.
Figure 3:
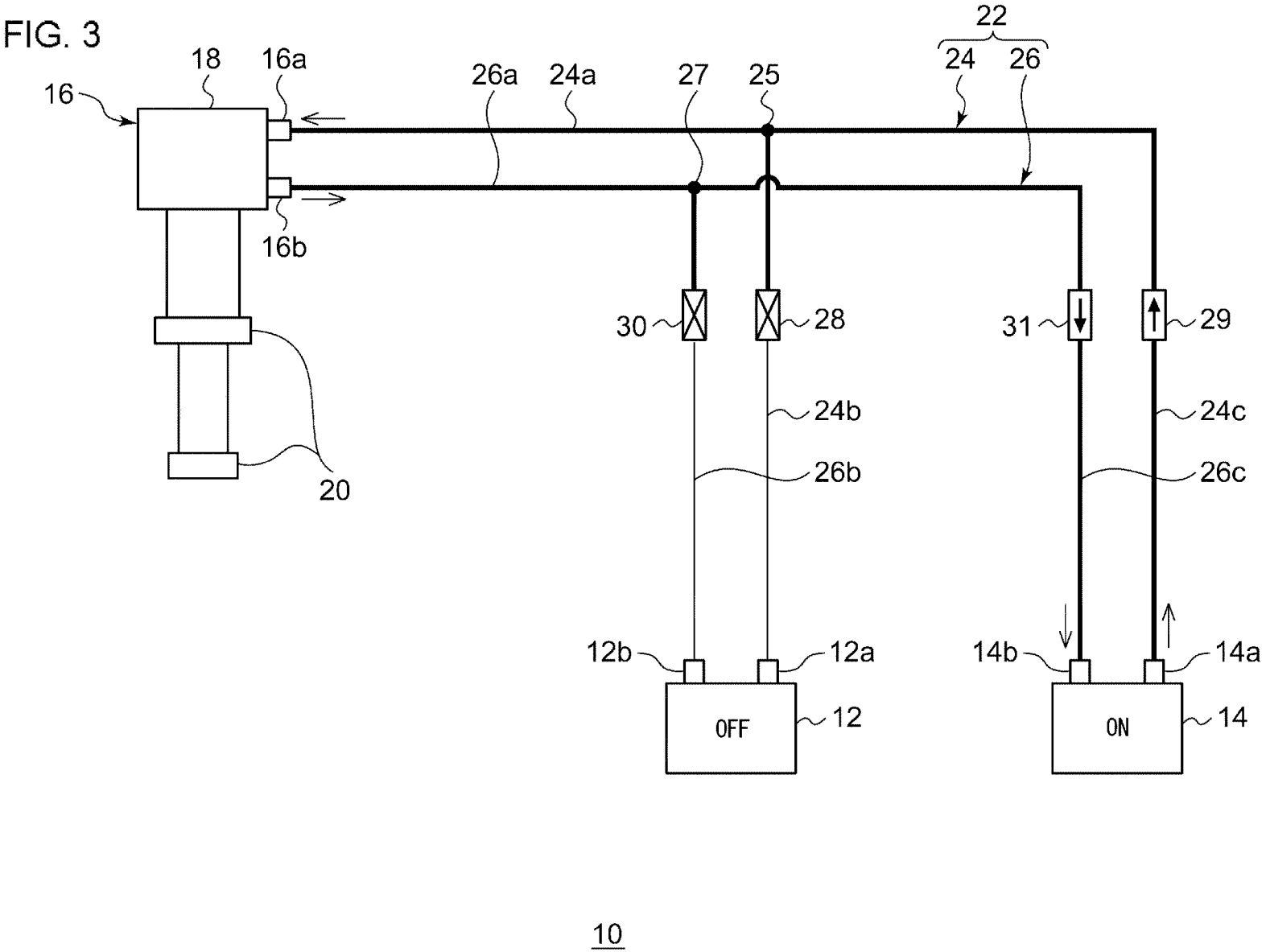
FIG. 3 is a diagram schematically showing the flow of the refrigerant gas in the cryocooler according to the one embodiment.

FIGS. 2 and 3 are diagrams schematically showing a flow of a refrigerant gas in the cryocooler 10 according to the one embodiment. To facilitate understanding, in the high pressure line 24 and the low pressure line 26, portions in which the refrigerant gas is flowing are shown with thick lines, and portions in which the refrigerant gas is not flowing are shown with thin lines.

FIG. 2 shows the flow of a refrigerant gas at normal times when the cryocooler 10 operates normally. As described above, at normal times, the first compressor 12 is operated and the second compressor 14 is stopped.

A high-pressure refrigerant gas compressed by the first compressor 12 is delivered to the high pressure line 24 from the first discharge port 12*a* of the first compressor 12. The refrigerant gas flows from the first high pressure sub-line 24*b* into the high pressure port 16*a* of the cold head 16 via the merging portion 25 and the high pressure main line 24*a*. Since the refrigerant gas flows in the forward direction of the high pressure line 24, the refrigerant gas can flow through the first check valve 28. Since the second compressor 14 is stopped, the refrigerant gas is not discharged from the second discharge port 14*a* of the second compressor 14. For this reason, as for the second check valve 29 of the second high pressure sub-line 24*c*, a pressure of the refrigerant gas on the upstream side in the forward direction falls short of a pressure of the refrigerant gas on the downstream side in the forward direction, and the second check valve 29 is closed. Consequently, the second check valve 29 blocks a backflow of the refrigerant gas from the first high pressure sub-line 24*b* to the second high pressure sub-line 24*c*.

In this manner, a high-pressure refrigerant gas can be supplied from the first compressor 12 to the cold head 16 through the high pressure line 24. In addition, a backflow from the first compressor 12 to the second compressor 14 through the high pressure line 24 is prevented.

A low-pressure refrigerant gas exhausted from the cold head 16 is delivered to the low pressure line 26 from the low pressure port 16*b* of the cold head 16. The refrigerant gas flows from the low pressure main line 26*a* into the first suction port 12*b* of the first compressor 12 via the diverting portion 27 and the first low pressure sub-line 26*b*. Since the refrigerant gas flows in the forward direction of the low pressure line 26, the refrigerant gas can flow through the third check valve 30. Since the second compressor 14 is stopped, the refrigerant gas is not sucked from the second suction port 14*b* of the second compressor 14. For this reason, as for the fourth check valve 31 of the second low pressure sub-line 26*c*, a pressure on the downstream side in the forward direction is higher than a pressure on the upstream side in the forward direction, and the fourth check valve 31 is closed. Consequently, the fourth check valve 31 blocks a backflow of the refrigerant gas from the second low pressure sub-line 26*c* to the first low pressure sub-line 26*b*.

In this manner, a low-pressure refrigerant gas can be collected from the cold head 16 to the first compressor 12 through the low pressure line 26. In addition, a backflow from the second compressor 14 to the first compressor 12 through the low pressure line 26 is prevented.

In the second compressor 14, the second discharge port 14*a* and the second suction port 14*b* are typically pressure-equalized when stopped. That is, both of the second discharge port 14*a* and the second suction port 14*b* each are an average pressure of the high pressure and the low pressure (for example, the average pressure is 1.3 MPa insofar as the high pressure is 2 MPa and the low pressure is 0.6 MPa). Consequently, both of the second check valve 29 and the fourth check valve 31 each have an outlet pressure remarkably higher than an inlet pressure, and are reliably closed by the pressure difference.

FIG. 3 shows the flow of a refrigerant gas at abnormal times when the first compressor 12 is stopped due to some factor. The first compressor 12 is stopped, and the second compressor 14 operates as a standby compressor. As described above, the first compressor 12 can be abnormally stopped due to various external factors which are impossible to be controlled and are difficult to be responded by the cryocooler 10 itself such as a power failure, a malfunction of cooling facilities, and an abnormal fluctuations in the ambient environment including a temperature, humidity, and an air pressure.

A high-pressure refrigerant gas compressed by the second compressor 14 is delivered to the high pressure line 24 from the second discharge port 14*a* of the second compressor 14. The refrigerant gas flows from the second high pressure sub-line 24*c* into the high pressure port 16*a* of the cold head 16 via the merging portion 25 and the high pressure main line 24*a*. Since the refrigerant gas flows in the forward direction of the high pressure line 24, the refrigerant gas can flow through the second check valve 29. Since the first compressor 12 is stopped, the refrigerant gas is not discharged from the first discharge port 12*a* of the first compressor 12. For this reason, as for the first check valve 28 of the first high pressure sub-line 24*b*, a pressure of the refrigerant gas on the upstream side in the forward direction falls short of a pressure of the refrigerant gas on the downstream side in the forward direction, and the first check valve 28 is closed. Consequently, the first check valve 28 blocks a backflow of the refrigerant gas from the second high pressure sub-line 24*c* to the first high pressure sub-line 24*b*.

In this manner, a high-pressure refrigerant gas can be supplied from the second compressor 14 to the cold head 16 through the high pressure line 24. In addition, a backflow from the first compressor 12 to the second compressor 14 through the high pressure line 24 is prevented.

A low-pressure refrigerant gas exhausted from the cold head 16 is delivered to the low pressure line 26 from the low pressure port 16*b* of the cold head 16. The refrigerant gas flows from the low pressure main line 26*a* into the second suction port 14*b* of the second compressor 14 via the diverting portion 27 and the second low pressure sub-line 26*c*. Since the refrigerant gas flows in the forward direction of the low pressure line 26, the refrigerant gas can flow through the fourth check valve 31. Since the first compressor 12 is stopped, the refrigerant gas is not sucked from the first suction port 12*b* of the first compressor 12. For this reason, as for the third check valve 30 of the first low pressure sub-line 26*b*, a pressure on the downstream side in the forward direction is higher than a pressure on the upstream side in the forward direction, and the third check valve 30 is closed. Consequently, the third check valve 30 blocks a backflow of the refrigerant gas from the first low pressure sub-line 26*b* to the second low pressure sub-line 26*c*.

In this manner, a low-pressure refrigerant gas can be collected from the cold head 16 to the second compressor 14 through the low pressure line 26. In addition, a backflow from the first compressor 12 to the second compressor 14 through the low pressure line 26 is prevented.

Similar to the second compressor 14, in the first compressor 12, the first discharge port 12*a* and the first suction port 12*b* are typically pressure-equalized when stopped. Consequently, both of the first check valve 28 and the third check valve 30 each have an outlet pressure remarkably higher than an inlet pressure, and are reliably closed by the pressure difference, thereby preventing a backflow.

Therefore, according to the cryocooler 10 according to the one embodiment, the cold head 16 can be cooled by using the first compressor 12 at normal times. The pipe system 22 has the check valves (28 to 31) in the sub-lines (24*b*, 24*c*, 26*b*, and 26*c*), respectively. For this reason, as shown in FIG. 2, a state where the second compressor 14 is separated from the cold head 16 can be spontaneously realized by the action of a differential pressure accompanying a refrigerant gas flow without requiring electrical control.

On the other hand, the cryocooler 10 can cool the cold head 16 using the second compressor 14 when the first compressor 12 stops abnormally. In addition, as shown in FIG. 3, a state where the first compressor 12 is separated from the cold head 16 can be spontaneously realized without requiring electrical control.

In this manner, the cryocooler 10 according to the one embodiment can switch the running compressor from the first compressor 12 to the second compressor 14 and continue cooling operation of the cold head 16. In the cryocooler 10 according to the one embodiment, the operation of the cryocooler 10 can be more reliably continued compared to a configuration of the related art, in which a three-port switching valve of which switching is electrically controlled is included.

In trial production by the present inventor, in the cryocooler 10 according to the one embodiment, fluctuations in a pressure of a refrigerant gas and a change in a cooling temperature of the low-temperature section 20 of the cold head 16 are found immediately after operation switching between the two compressors (12 and 14). However, it has been confirmed that such a change quickly converges within allowable time, and then the cold head 16 can be maintained at a desired target cooling temperature similar to before the operation switching of the compressor.

In addition, in the study by the present inventor, in a case where the electrically controlled three-port switching valve is adopted, a large and expensive three-port switching valve may be required since a refrigerant gas from the two compressors gathers in the switching valve and the flow rate of the refrigerant gas flowing through the switching valve relatively increases. This is disadvantageous from a perspective of reducing manufacturing costs of the cryocooler. On the other hand, in the cryocooler 10 according to the one embodiment, a general-purpose check valve that operates at a differential pressure can be adopted, and such a check valve has a relatively simple structure and is inexpensive, thereby contributing to reducing manufacturing costs as well.

In addition, it is also possible for the cryocooler 10 to simultaneously operate the first compressor 12 and the second compressor 14.

In this case, as shown in FIG. 1, a high-pressure refrigerant gas compressed by the first compressor 12 is delivered from the first discharge port 12*a* of the first compressor 12 to the first high pressure sub-line 24*b*. Since the refrigerant gas flows in the forward direction of the high pressure line 24, the refrigerant gas can flow through the first check valve 28. Similarly, the high-pressure refrigerant gas compressed by the second compressor 14 is delivered from the second discharge port 14*a* of the second compressor 14 to the second high pressure sub-line 24*c*. Since the refrigerant gas flows in the forward direction of the high pressure line 24, the refrigerant gas can flow through the second check valve 29. The two refrigerant gas flows merge at the merging portion 25 and are directed to the high pressure port 16*a* of the cold head 16 via the high pressure main line 24*a*. In this manner, a high-pressure refrigerant gas can be supplied from the first compressor 12 and the second compressor 14 to the cold head 16 through the high pressure line 24.

A low-pressure refrigerant gas exhausted from the cold head 16 is delivered from the low pressure port 16*b* of the cold head 16 to the low pressure main line 26*a*, and is diverted to the first low pressure sub-line 26*b* and the second low pressure sub-line 26*c* at the diverting portion 27. Since the refrigerant gas flows in the forward direction of the low pressure line 26, the refrigerant gas can flow to the first suction port 12*b* of the first compressor 12 and the second suction port 14*b* of the second compressor 14 through the third check valve 30 and the fourth check valve 31, respectively. In this manner, a low-pressure refrigerant gas can be collected from the cold head 16 to the first compressor 12 and the second compressor 14 through the low pressure line 26.

As described above, by simultaneously operating the two compressors (12 and 14), a larger amount of refrigerant gas can be supplied to the cold head 16 than the flow rate of a refrigerant gas that can be supplied from one compressor to the cold head 16. Consequently, the cryocooler 10 can provide a higher cooling capacity by simultaneously operating the two compressors.

Separately using the simultaneous operation of the two compressors (12 and 14) and the operation of only one compressor depending on a desired cooling capacity contributes to reducing the power consumption of the cryocooler 10. For example, by simultaneously operating the compressors in a special situation where a high cooling capacity is desired and operating only one compressor in a normal situation where that high cooling capacity is not required, the power consumption of the cryocooler 10 can be reduced compared to a case where of simultaneously operating the compressors at all times.

In addition, a configuration of the pipe system 22 in which a refrigerant gas is supplied from both of the compressors to the cold head 16, and a configuration of the pipe system 22 in which a refrigerant gas is supplied from only one compressor to the cold head 16 and the other compressor is separated from the cold head 16 can be easily switched by turning on and off the individual compressors without requiring electrical control.

Although each of the four check valves is prepared as an individual component and is individually combined with the pipe system 22 using a connecting pipe such as a flexible pipe in the embodiment described above, this configuration is not essential. In a certain embodiment, the pipe system 22 may have a single component in which the four check valves are incorporated as will be mentioned below with reference to FIG. 4.

Figure 4:
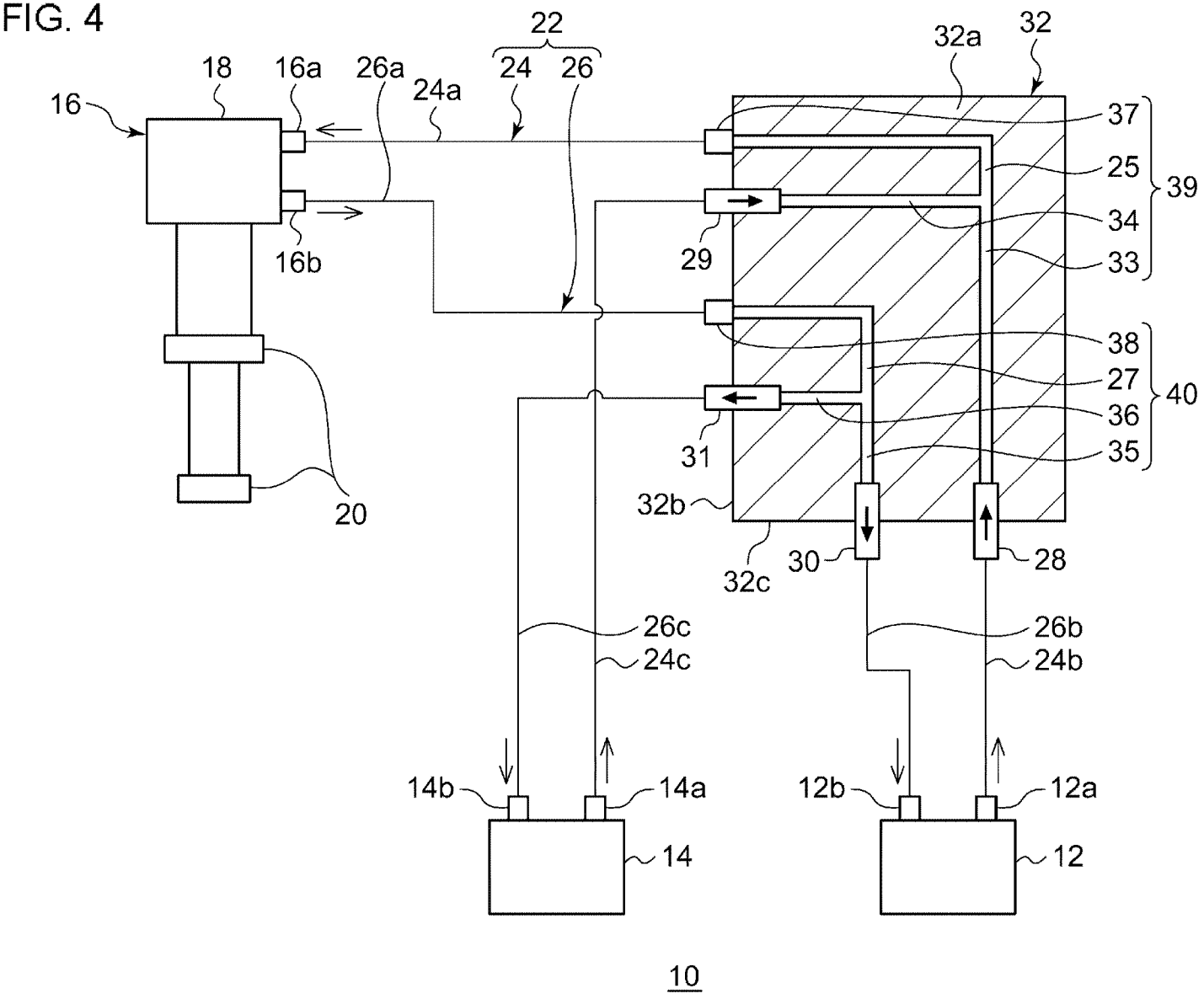
FIG. 4 is a diagram schematically showing another example of the cryocooler according to the one embodiment.

FIG. 4 is a diagram schematically showing another example of the cryocooler 10 according to the one embodiment. The pipe system 22 of the cryocooler 10 includes a manifold 32 that configures a part of each of the high pressure line 24 and the low pressure line 26. The manifold 32 has the merging portion 25 and the diverting portion 27, and the first check valve 28, the second check valve 29, the third check valve 30, and the fourth check valve 31 are built therein. Since configurations of the other portions of the cryocooler 10 shown in FIG. 4 are the same as the embodiment described with reference to FIGS. 1 to 3, the same components will be assigned with the same reference symbols, and redundant description thereof will be omitted as appropriate.

The manifold 32 has, for example, a rectangular parallelepiped shape or other appropriate three-dimensional outer shape, and includes a manifold block 32*a* in which some internal flow paths are formed. FIG. 4 schematically shows a section of the manifold block 32*a* including the internal flow paths in order to facilitate understanding of the internal flow paths.

A first high pressure flow path 33 and a second high pressure flow path 34, which merge at the merging portion 25, are formed in the manifold block 32*a*. The first check valve 28 and the second check valve 29 are disposed at inlet ends (that is, ends on an opposite side to the merging portion 25) of the first high pressure flow path 33 and the second high pressure flow path 34, respectively. The merging portion 25 forms a high pressure outlet 37 in one wall surface 32*b* of the manifold block 32*a*, and the high pressure outlet 37 is connected to the high pressure port 16*a* of the cold head 16 by the high pressure main line 24*a*.

A first low pressure flow path 35 and a second low pressure flow path 36, which are branched from the diverting portion 27, are formed in the manifold block 32*a*. The third check valve 30 and the fourth check valve 31 are disposed at outlet ends (that is, ends on an opposite side to the diverting portion 27) of the first low pressure flow path 35 and the second low pressure flow path 36, respectively. The diverting portion 27 forms a low pressure inlet 38 in the same wall surface 32*b* of the manifold block 32*a* as the high pressure outlet 37, and the low pressure inlet 38 is connected to the low pressure port 16*b* of the cold head 16 by the low pressure main line 26*a*.

The first check valve 28 and the third check valve 30 are provided in one wall surface 32*c* of the manifold block 32*a*, which is different from the wall surface where there are the high pressure outlet 37 and the low pressure inlet 38. The two wall surfaces 32*b* and 32*c* are surfaces adjacent to each other. In addition, the second check valve 29 and the fourth check valve 31 are provided in the wall surface 32*b* in which the high pressure outlet 37 and the low pressure inlet 38 are provided.

According to such disposition of the high pressure outlet 37, the low pressure inlet 38, and the check valves (28 to 31), the internal flow paths (33 to 36) of the manifold 32 can be manufactured through drilling from the wall surfaces 32*b* and 32*c* of the manifold block 32*a*. Manufacturing is easy and this is an advantage.

However, such disposition of the high pressure outlet 37, the low pressure inlet 38, and the check valves (28 to 31) is an example, and it is clear that providing in other wall surfaces in a variety of ways is also possible. For example, it is also possible to dispose such that the high pressure outlet 37 and the low pressure inlet 38 are provided in one surface (for example, the wall surface 32*b*) of the manifold block 32*a*, the first check valve 28 and the third check valve 30 are provided in a surface adjacent thereto (for example, the wall surface 32*c*) or a surface on an opposite side thereto, and the second check valve 29 and the fourth check valve 31 are provided in a surface (for example, an upper surface and a lower surface of the manifold block 32*a*) adjacent to the two surfaces.

A high-pressure refrigerant gas can flow into the manifold 32 from the first compressor 12 through the first high pressure sub-line 24*b* and the first check valve 28. The refrigerant gas flows out from the manifold 32 to the high pressure main line 24*a* through the first high pressure flow path 33, the merging portion 25, and the high pressure outlet 37, and is supplied to the cold head 16. Similarly, the high-pressure refrigerant gas can flow into the manifold 32 from the second compressor 14 through the second high pressure sub-line 24*c* and the second check valve 29. The refrigerant gas flows out from the manifold 32 to the high pressure main line 24*a* through the second high pressure flow path 34, the merging portion 25, and the high pressure outlet 37, and is supplied to the cold head 16.

In addition, a low-pressure refrigerant gas exhausted from the cold head 16 flows into the manifold 32 from the low pressure inlet 38 through the low pressure main line 26*a*. The refrigerant gas flows out to the first low pressure sub-line 26*b* from the manifold 32 through the diverting portion 27, the first low pressure flow path 35, and the third check valve 30, and is collected in the first compressor 12. Alternatively, the refrigerant gas flows out to the second low pressure sub-line 26*c* from the manifold 32 through the diverting portion 27, the second low pressure flow path 36, and the fourth check valve 31, and is collected in the second compressor 14.

In this manner, the first high pressure flow path 33, the second high pressure flow path 34, the merging portion 25, and the high pressure outlet 37 form a high pressure region 39 in the manifold block 32*a*. The first low pressure flow path 35, the second low pressure flow path 36, the diverting portion 27, and the low pressure inlet 38 form a low pressure region 40 in the manifold block 32*a*. The manifold 32 is configured to separate the high pressure region 39 and the low pressure region 40 from each other.

The manifold 32 is configured as a single component that combines the four check valves (28 to 31). By doing so, compared to a case where the four check valves are prepared as individual components, pipe connection work in the field where the cryocooler 10 is used can be made easier.

Figure 5:
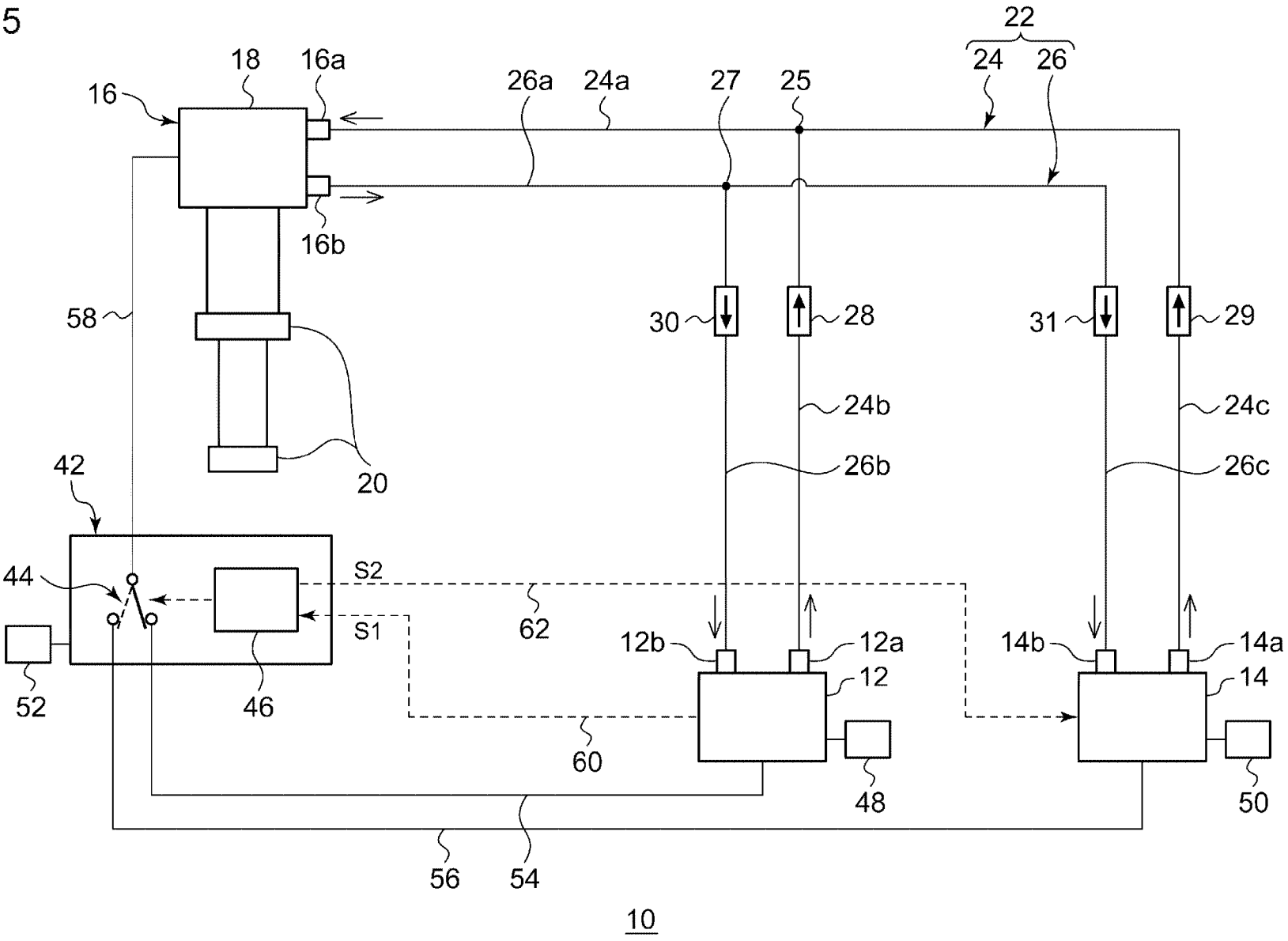
FIG. 5 is a diagram schematically showing a cryocooler according to another embodiment.

FIG. 5 is a diagram schematically showing the cryocooler 10 according to another embodiment. The cryocooler 10 according to another embodiment further includes a useful power supply configuration which is also applicable to each of the embodiments described above. Since the pipe system 22 of the cryocooler 10 according to another embodiment is the same as in the embodiment described above, the same components will be assigned with the same reference symbols, and redundant description thereof will be omitted as appropriate.

Also in another embodiment, the first compressor 12 is provided in the cryocooler 10 as a main compressor which is normally used in the cryocooler 10 as in the one embodiment. The second compressor 14 is provided in the cryocooler 10 as a standby compressor used as a substitute for the first compressor 12 when the first compressor 12 has stopped due to some factor. It is also possible to operate the first compressor 12 and the second compressor 14 simultaneously.

The first compressor 12 is electrically connected to the cold head 16 as a main power supply of the cold head 16, and the second compressor 14 is electrically connected to the cold head 16 as a standby power supply of the cold head 16. The cryocooler 10 further includes a switching device 42 that is configured to switch power supply to the cold head 16 between the first compressor 12 and the second compressor 14 depending on an operation state of the first compressor 12.

The first compressor 12 is configured to output a first compressor signal S1 indicating the operation state of the first compressor 12 to the switching device 42. The first compressor signal S1 is a signal that indicates, for example, any one of on and off states of the first compressor 12 as the operation state of the first compressor 12. The switching device 42 includes a switch 44 that switches power supply to the cold head 16 between the first compressor 12 and the second compressor 14 and a switch control unit 46 that controls a starting timing of the second compressor 14 and the switch 44 based on the first compressor signal S1.

The switch control unit 46 is configured to output a starting command signal S2 of the second compressor 14 to the second compressor 14 based on the first compressor signal S1. The second compressor 14 is configured to start in response to the starting command signal S2. That is, the second compressor 14 is switched from an off state to an on state when the second compressor receives the starting command signal S2.

The switching device 42 is realized by an element or a circuit including a CPU and a memory of a computer as a hardware configuration and is realized by a computer program as a software configuration, but is shown in FIG. 5 as a functional block realized in cooperation therewith. It is clear for those skilled in the art that the functional blocks can be realized in various manners in combination with hardware and software.

The switch 44 may be, for example, a mechanical switch, a semiconductor switching device, or any other type of switch capable of switching electrical connections. The switch control unit 46 may be, for example, a relay or any other type of switch control circuit configured to control on and off states of the switch 44.

The first compressor 12 is supplied with power from a main power supply 48 such as a commercial power supply, and the second compressor 14 is supplied with power from a standby power supply 50 such as a battery and a generator. The switching device 42 is supplied with power from a switching device power supply 52. The switching device power supply 52 may be the standby power supply 50, or may be a standby power supply different from the standby power supply 50.

The first compressor 12 and the switching device 42 are connected to each other by a first power supply line 54, and the second compressor 14 and the switching device 42 are connected to each other by a second power supply line 56. In addition, the room temperature section 18 of the cold head 16 and the switching device 42 are connected to each other by a cold head cable 58. The switch 44 connects any one of the first power supply line 54 and the second power supply line 56 to the cold head cable 58 under the control of the switch control unit 46. The cold head cable 58 includes any one or both of a power supply line and a signal line. For example, the power supply lines including the first power supply line 54, the second power supply line 56, and the cold head cable 58 are AC 200V power supply lines.

In addition, the first compressor 12 and the switching device 42 are connected to each other by a first signal line 60, and the second compressor 14 and the switching device 42 are connected to each other by a second signal line 62. The first signal line 60 allows the first compressor signal S1 to be transmitted from the first compressor 12 to the switch control unit 46, and the second signal line 62 allows the starting command signal S2 to be transmitted from the switch control unit 46 to the second compressor 14. For example, the first signal line 60 and the second signal line 62 are DC 24V signal lines.

The first compressor 12 is configured to output the first compressor signal S1 to the switch control unit 46 of the switching device 42 when running and not to output the first compressor signal S1 when stopped. The operation state of the first compressor 12 is represented by the presence or absence of the first compressor signal S1. For example, the first compressor signal S1 is, for example, a DC 24V or other constant voltage signal, is always output during the running of the first compressor 12, and is not output during the stop of the first compressor, such as abnormal stop.

Alternatively, the first compressor 12 may be configured to output the first compressor signal S1 indicating a running state (on) to the switch control unit 46 of the switching device 42 during running, and to output the first compressor signal S1 indicating a stopped state (off) when stopped. The first compressor 12 may be configured to output the first compressor signal S1 indicating an off state of the first compressor 12 to the switch control unit 46 of the switching device 42 at least at a timing when being switched from an on state to the off state. The first compressor signal S1 may indicate whether the first compressor 12 is running or stopped through a high or low binary option of a voltage, a current, or other appropriate electrical output. The first compressor signal S1 may be any electric signal or control signal that indicates the operation state of the first compressor 12.

The switch control unit 46 is configured to output the starting command signal S2 at a starting timing of the second compressor 14 determined from the first compressor signal S1. The starting timing of the second compressor 14 is represented by the presence or absence of the starting command signal S2. For example, the starting command signal S2 is, for example, DC 24V or other constant voltage signal, and is output only at the starting timing of the second compressor 14. The starting command signal S2 may be a voltage, a current, or other appropriate electric signal or control signal.

Figure 6:
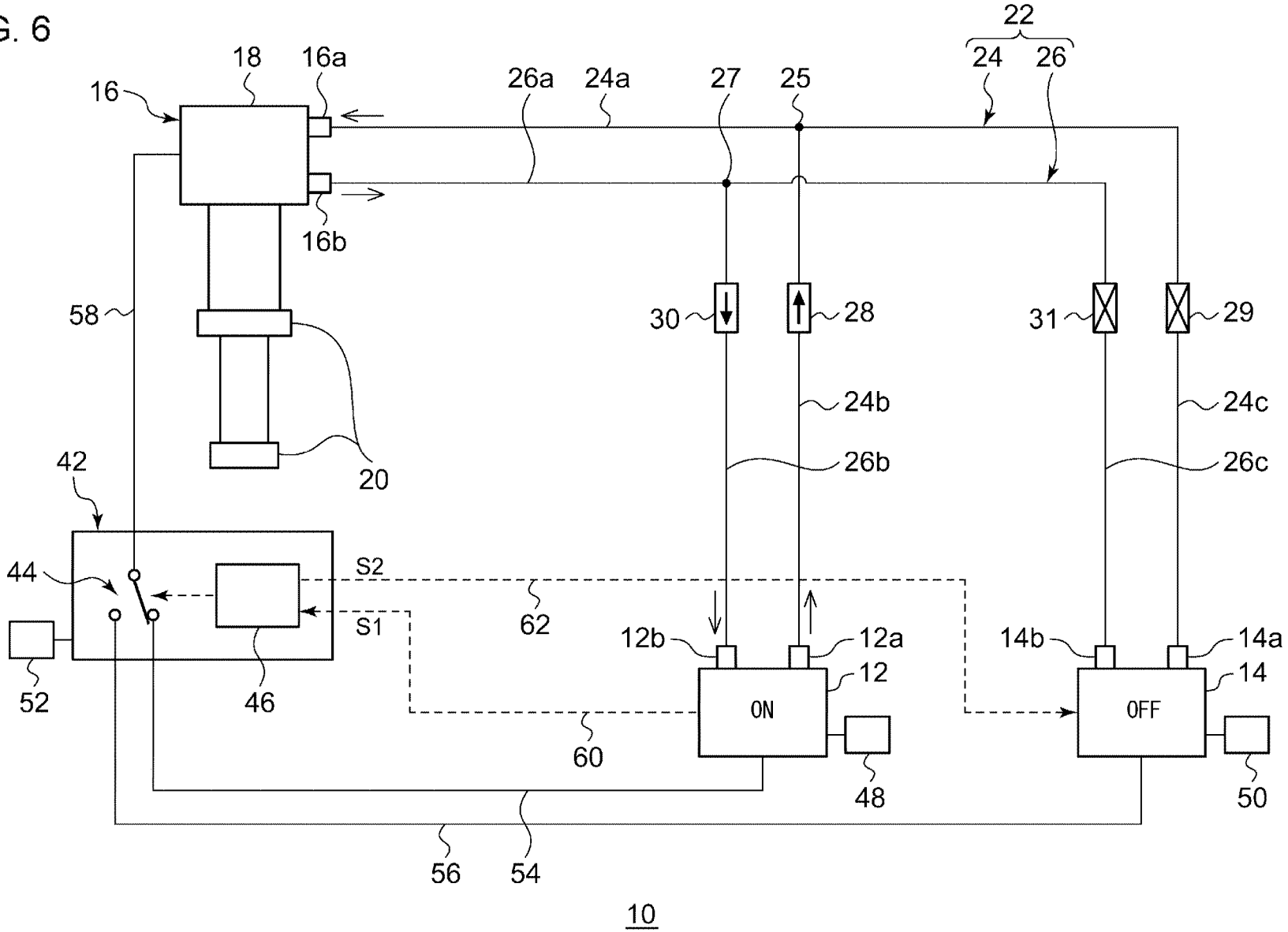
FIG. 6 is a diagram schematically showing an operation of the cryocooler according to another embodiment.
Figure 7:
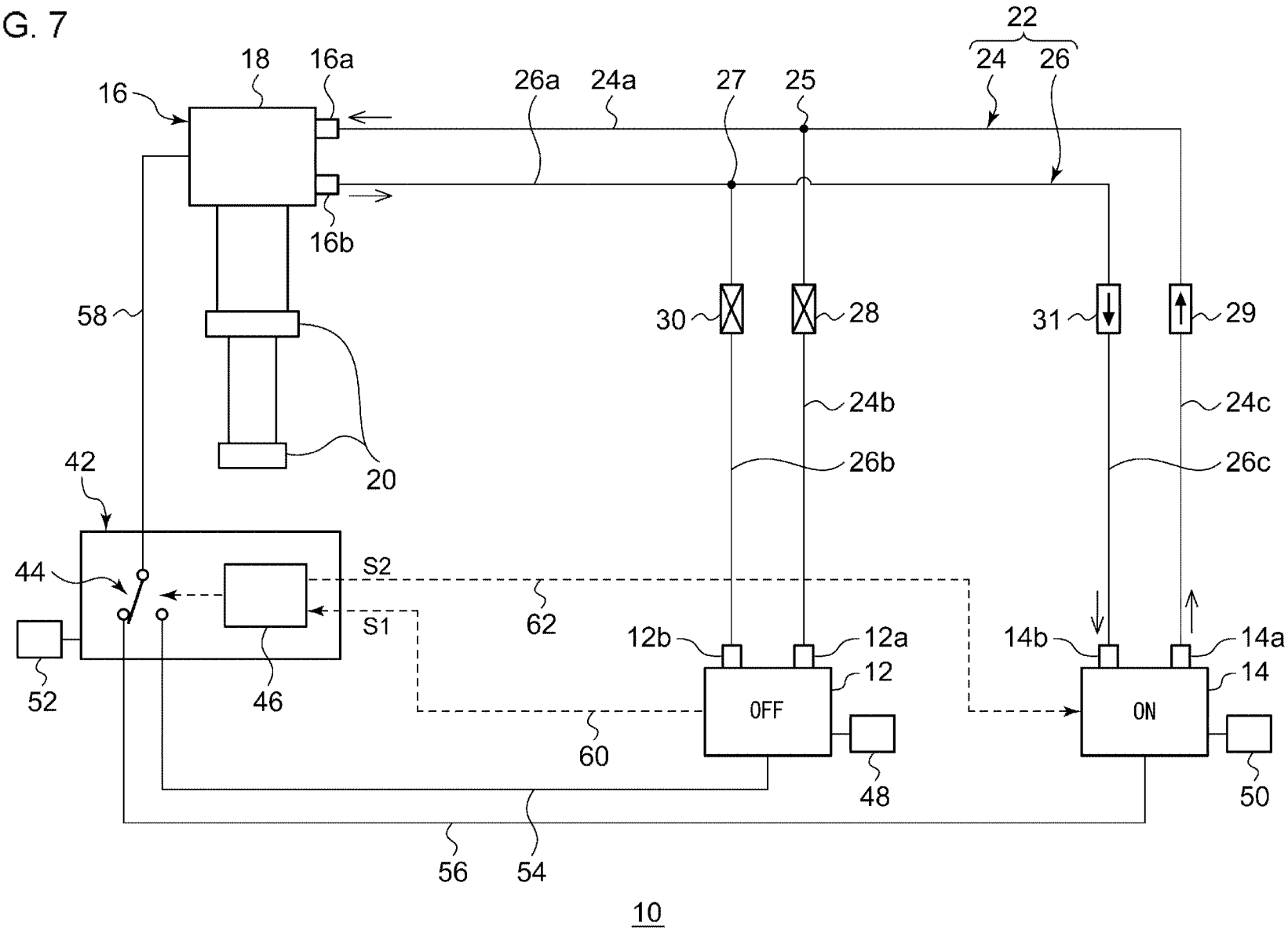
FIG. 7 is a diagram schematically showing the operation of the cryocooler according to another embodiment.

FIGS. 6 and 7 are diagrams schematically showing an operation of the cryocooler 10 according to another embodiment. FIG. 6 shows a flow of a refrigerant gas and a state of the switching device 42 at normal times when the cryocooler 10 operates normally. FIG. 7 shows a flow of a refrigerant gas and a state of the switching device 42 at abnormal times when the first compressor 12 is stopped due to some factor. To facilitate understanding, in the high pressure line 24 and the low pressure line 26, portions in which the refrigerant gas is flowing are shown with thick lines, and portions in which the refrigerant gas is not flowing are shown with thin lines.

As shown in FIG. 6, since the first compressor 12 is running at normal times, the first compressor signal S1 input to the switching device 42 indicates that the first compressor signal S1 is turned on. In this manner, in a case where the first compressor signal S1 indicates an on state, the switch control unit 46 connects the switch 44 to the first power supply line 54. Consequently, the first compressor 12 supplies power to the cold head 16.

In this case, the switch control unit 46 does not start the second compressor 14 and leaves the second compressor turned off. That is, the switch control unit 46 does not output the starting command signal S2 or outputs a signal instructing to turn off to the second compressor 14 through the second signal line 62.

A refrigerant gas flow in the pipe system 22 shown in FIG. 6 is the same as the refrigerant gas flow shown in FIG. 2. Since the first compressor 12 is operated and the second compressor 14 is stopped, a high-pressure refrigerant gas is supplied from the first compressor 12 to the cold head 16 through the high pressure line 24, and a low-pressure refrigerant gas is collected from the cold head 16 to the first compressor 12 through the low pressure line 26. The second check valve 29 prevents a backflow from the first compressor 12 to the second compressor 14 through the high pressure line 24, and the fourth check valve 31 also prevents a backflow from the second compressor 14 through the low pressure line 26.

As shown in FIG. 7, in a case where the first compressor signal S1 indicates an off state, the switch control unit 46 connects the switch 44 to the second power supply line 56. Simultaneously with switching the first compressor signal S1 from an on state to the off state, also the switch 44 switches from the first power supply line 54 to the second power supply line 56. Simultaneously, the switch control unit 46 outputs the starting command signal S2 to the second compressor 14. In this manner, the second compressor 14 is switched from an off state to an on state, and the operation of the second compressor 14 is started. Even when the first compressor 12 stops, the second compressor 14 continues to supply power to the cold head 16.

A refrigerant gas flow in the pipe system 22 shown in FIG. 7 is the same as the refrigerant gas flow shown in FIG. 3. Since the second compressor 14 is operated and the first compressor 12 is stopped, a high-pressure refrigerant gas is supplied from the second compressor 14 to the cold head 16 through the high pressure line 24, and a low-pressure refrigerant gas is collected from the cold head 16 to the second compressor 14 through the low pressure line 26. The first check valve 28 prevents a backflow from the second compressor 14 to the first compressor 12 through the high pressure line 24, and the third check valve 30 also prevents a backflow from the first compressor 12 through the low pressure line 26.

In this manner, the cryocooler 10 according to another embodiment has a power supply system in which the first compressor 12 is the main power supply of the cold head 16 and the second compressor 14 is the standby power supply of the cold head 16. While the power supply system performs switching depending on the operation state of the first compressor 12 such that the first compressor 12 is used when the first compressor 12 is turned on and the second compressor 14 is used when the first compressor 12 is turned off. Therefore, power supply to the cold head 16 is continued regardless of the operation state of the first compressor 12.

In addition, the first compressor 12 outputs the first compressor signal S1 to the switching device 42, and the switching device 42 includes the switch 44 and the switch control unit 46. Accordingly, as described above, when the first compressor 12 stops abnormally, the power supply and a refrigerant gas source of the cold head 16 can be collectively switched to the second compressor 14 quickly. For example, immediately after the first compressor 12 is stopped, the cryocooler 10 automatically switches the power supply and the refrigerant gas source of the cold head 16 to the second compressor 14, for example, within approximately 30 seconds or within approximately 1 minute. In this manner, the cryocooler 10 can maintain the cooling of the low-temperature section 20.

Similarly, the switching device 42 may be configured to start the first compressor 12 when the second compressor 14 stops. In this case, the second compressor 14 is configured to output a second compressor signal indicating the operation state of the second compressor 14 to the switching device 42. The second compressor signal may be, for example, a DC 24V constant voltage signal or another electric signal just as the first compressor signal S1. The switch control unit 46 may control a starting timing of the first compressor 12 and the switch 44 based on the second compressor signal.

By doing so, when the repair or replacement of the first compressor 12 is completed after the abnormal stop of the first compressor 12, work of returning the first compressor 12 to the cryocooler 10 is easy. By switching the second compressor 14 from an on state to an off state, the first compressor 12 can be automatically run again.

The present invention has been described based on the embodiments. It is clear for those skilled in the art that the present invention is not limited to the embodiments, various design changes are possible, various modification examples are possible, and such modification examples are also within the scope of the present invention.

Various characteristics described related to one embodiment are also applicable to the other embodiment. A new embodiment generated through combination also has the effects of each of the combined embodiments.

Although the cryocooler 10 has one cold head 16 and two compressors (12 and 14) in the embodiments described above, the invention is not limited to such combination. For example, the cryocooler 10 may have one cold head 16 and three or more compressors.

It is possible to use the present invention in the field of cryocoolers and cryocooler pipe systems.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a first compressor;

a second compressor;

a cold head that has a high pressure port and a low pressure port;

a high pressure line that is configured such that a refrigerant gas is able to flow from the first compressor and the second compressor to the high pressure port of the cold head via a merging point, the high pressure line including a first high pressure sub-line which connects the first compressor to the merging point and has a first check valve and a second high pressure sub-line which connects the second compressor to the merging point and has a second check valve;

a low pressure line that is configured such that the refrigerant gas is able to flow from the low pressure port of the cold head to the first compressor and the second compressor via a diverting point, the low pressure line including a first low pressure sub-line which connects the diverting point to the first compressor and has a third check valve and a second low pressure sub-line which connects the diverting point to the second compressor and has a fourth check valve; and a switching device electrically connecting the first compressor to the cold head as a main power supply of the cold head and electrically connecting the second compressor to the cold head as a standby power supply of the cold head, the switching device configured to switch power supply to the cold head between the first compressor and the second compressor depending on an operation state of the first compressor.

2. The cryocooler according to claim 1, wherein the first compressor is configured to output a first compressor signal indicating the operation state of the first compressor to the switching device, and the switching device includes a switch that switches the power supply to the cold head between the first compressor and the second compressor, and a switch controller configured to control a start timing of the second compressor and the switch based on the first compressor signal.

3. The cryocooler according to claim 1, further comprising:

a manifold that has the merging point and the diverting point and has the first check valve, the second check valve, the third check valve, and the fourth check valve which are built therein.

4. The cryocooler according to claim 1, wherein the switching device is connected to the cold head by a cold head cable, to the first compressor by a first power supply line and to the second compressor by a second power supply line.

5. A cryocooler comprising:

a first compressor;

a second compressor;

a cold head that has a high pressure port and a low pressure port;

a high pressure line that is configured such that a refrigerant gas is able to flow from the first compressor and the second compressor to the high pressure port of the cold head;

a low pressure line that is configured such that the refrigerant gas is able to flow from the low pressure port of the cold head to the first compressor and the second compressor; and a switching device electrically connecting the first compressor and the second compressor to the cold head and configured to switch power supply to the cold head between the first compressor and the second compressor depending on an operation state of the first compressor.

6. The cryocooler according to claim 5, wherein the switching device is connected to the cold head by a cold head cable, to the first compressor by a first power supply line and to the second compressor by a second power supply line.

7. The cryocooler according to claim 5, wherein the first compressor is electrically connected to a main power supply and the second compressor is electrically connected to a standby power supply.

8. The cryocooler according to claim 5, wherein the first compressor is configured to output a first compressor signal indicating the operation state of the first compressor to the switching device, and the switching device includes a switch that switches the power supply to the cold head between the first compressor and the second compressor, and a switch controller configured to control a start timing of the second compressor and the switch based on the first compressor signal.

9. A cryocooler power switching system comprising:

a cold head cable connected to a cold head of a cryocooler;

a first power supply line connected to a first compressor of the cryocooler;

a second power supply line connected to a second compressor of the cryocooler; and a switching device connected to the cold head by the cold head cable, to the first compressor by the first power supply line and to the second compressor by the second power supply line and configured to switch power supply to the cold head between the first compressor and the second compressor depending on an operation state of the first compressor.

10. The cryocooler power switching system according to claim 9, wherein the first compressor is electrically connected to a main power supply and the second compressor is electrically connected to a standby power supply.

11. The cryocooler power switching system according to claim 9, wherein the first compressor is configured to output a first compressor signal indicating the operation state of the first compressor to the switching device, and the switching device includes a switch that switches the power supply to the cold head between the first compressor and the second compressor, and a switch controller configured to control a start timing of the second compressor and the switch based on the first compressor signal.

* * * * *